US011547231B1

(12) United States Patent
Howard, II

(10) Patent No.: US 11,547,231 B1
(45) Date of Patent: Jan. 10, 2023

(54) EXPANDABLE BEVERAGE TRAY

(71) Applicant: Moses Howard, II, Marietta, GA (US)

(72) Inventor: Moses Howard, II, Marietta, GA (US)

( * ) Notice: Subject to any disclaimer, the term of this patent is extended or adjusted under 35 U.S.C. 154(b) by 3 days.

(21) Appl. No.: 17/171,122

(22) Filed: Feb. 9, 2021

(51) Int. Cl.
*A47G 23/06* (2006.01)

(52) U.S. Cl.
CPC ..... *A47G 23/0641* (2013.01); *A47G 23/0633* (2013.01)

(58) Field of Classification Search
CPC ..... A47G 23/0641; A47G 23/0633; A47G 23/06; A47G 23/02; A47G 23/0225; B65D 1/34; B65D 7/08; B65D 7/10; B65D 25/005; B65D 5/38; B65D 5/728; B65D 5/6617; B65D 9/08; B65D 11/12; B65D 2583/0468
USPC ..... 206/562–564, 557, 804, 758, 555, 454, 206/449; 220/23.88, 529, 528, 676, 558, 220/559; 312/126, 132, 228.1
See application file for complete search history.

(56) References Cited

U.S. PATENT DOCUMENTS 4,790,434 A * 12/1988 Schoberg ..... G11B 23/0236 190/110
5,052,552 A 10/1991 Maroszek
5,540,334 A * 7/1996 Haas ..... B65D 25/2885 422/561
5,706,966 A * 1/1998 Rothe ..... A47F 10/06 312/351
5,803,264 A 9/1998 Gersten
5,878,882 A * 3/1999 Kohagura ..... B25H 3/028 206/758
5,967,323 A * 10/1999 Siragusa ..... B65D 25/108 220/780
5,979,646 A * 11/1999 Strachan ..... B65D 71/70 206/217
6,126,256 A * 10/2000 Does, II ..... A47B 81/04 312/351
6,629,607 B1 * 10/2003 Gibson ..... A45C 11/20 229/906
6,827,207 B1 12/2004 Chen
D592,013 S 5/2009 Bizzell
7,832,554 B2 11/2010 Sutton-Rainey
8,997,995 B2 4/2015 Chitsazan
9,694,939 B1 6/2017 Hsieh
2010/0083778 A1 * 4/2010 Harris ..... B01L 9/523 220/528
2014/0054287 A1 * 2/2014 Kitazawa ..... B65D 83/0481 220/23.87

FOREIGN PATENT DOCUMENTS

WO 20099061304 5/2009

* cited by examiner

*Primary Examiner* — Robert Poon
(74) *Attorney, Agent, or Firm* — Kyle A. Fletcher, Esq.

(57) ABSTRACT

The expandable beverage tray comprises a carrier body, an intermediate tray, and a bottom tray. The expandable beverage tray may be adapted to hold beverages and food being delivered by a delivery person. A top surface of the carrier body may be adapted to hold a plurality of beverage cups in a first plurality of cup apertures. The intermediate tray and the bottom tray may reside within the carrier body. The intermediate tray may be adapted to slide out of the carrier body and hold more of the plurality of beverage cups in a second plurality of cup apertures. The bottom tray may be adapted to slide out of the carrier body and hold one or more food containers.

17 Claims, 7 Drawing Sheets

EXPANDABLE BEVERAGE TRAY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of food and beverage distribution aids, more specifically, an expandable beverage tray.

SUMMARY OF INVENTION

The expandable beverage tray comprise a carrier body, an intermediate tray, and a bottom tray. The expandable beverage tray may be adapted to hold beverages and food being delivered by a delivery person. A top surface of the carrier body may be adapted to hold a plurality of beverage cups in a first plurality of cup apertures. The intermediate tray and the bottom tray may reside within the carrier body aligned with the top surface such that the intermediate tray and the bottom tray do not interfere with the operation of the first plurality of cup apertures in the top surface and do not increase the footprint of the carrier body. The intermediate tray may be adapted to slide out of the carrier body towards the front or towards the rear and hold more of the plurality of beverage cups in a second plurality of cup apertures. The bottom tray may be adapted to slide out of the carrier body towards the front and hold one or more food containers. The intermediate tray and the bottom tray may slide independently of each other.

An object of the invention is to carry beverage cups and food containers being delivered by a delivery person.

Another object of the invention is to provide a first plurality of cup apertures in a top surface of the invention for carrying a plurality of beverage cups.

A further object of the invention is to provide a second plurality of cup apertures in a slide-out intermediate tray to increase the number of beverages cups that may be carried.

Yet another object of the invention is to provide a slide-out bottom tray than may be used to carry one or more good containers.

These together with additional objects, features and advantages of the expandable beverage tray will be readily apparent to those of ordinary skill in the art upon reading the following detailed description of the presently preferred, but nonetheless illustrative, embodiments when taken in conjunction with the accompanying drawings.

In this respect, before explaining the current embodiments of the expandable beverage tray in detail, it is to be understood that the expandable beverage tray is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the expandable beverage tray.

It is therefore important that the claims be regarded as including such equivalent construction insofar as they do not depart from the spirit and scope of the expandable beverage tray. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
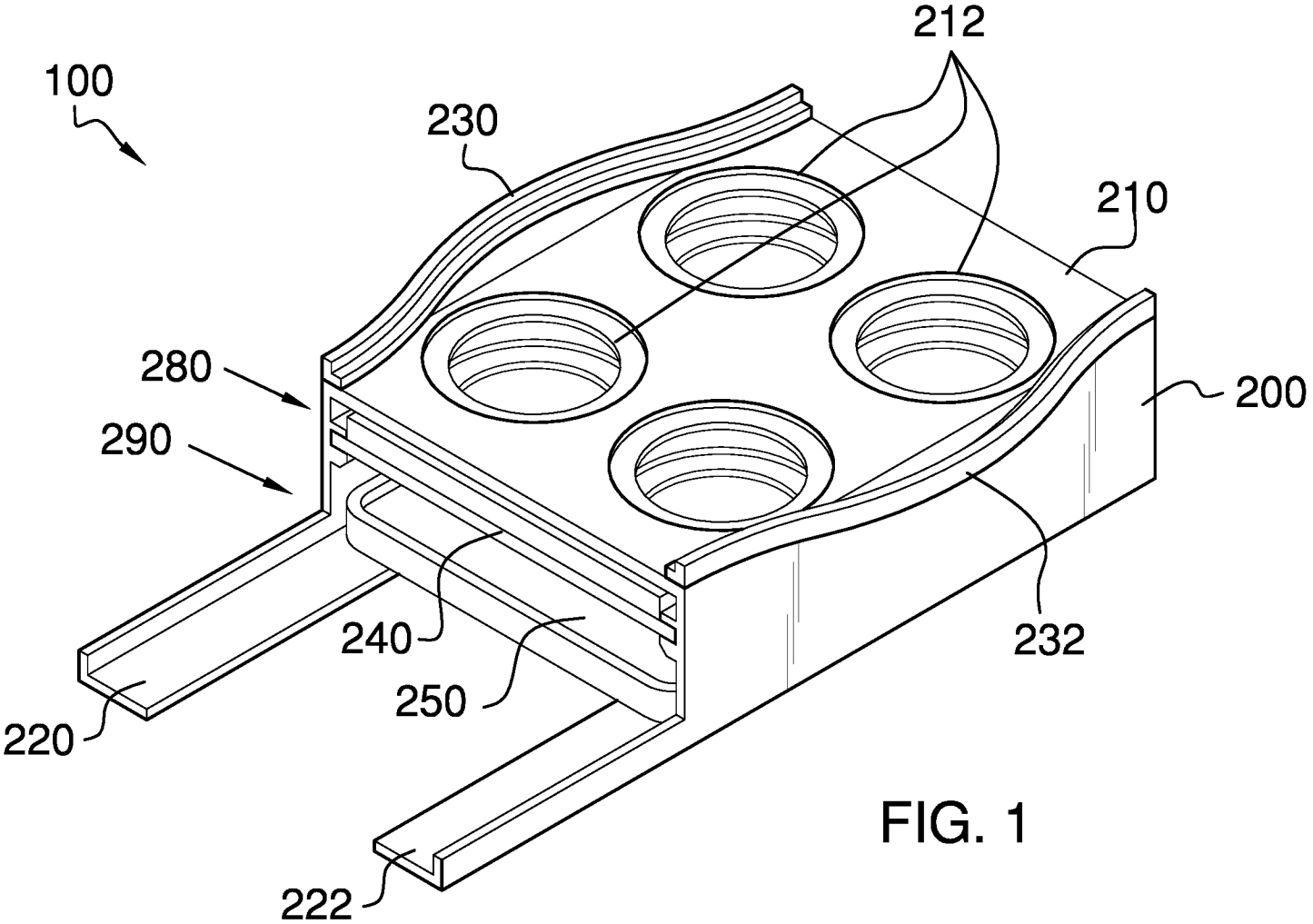
FIG. 1 is an isometric view of an embodiment of the disclosure.
Figure 2:
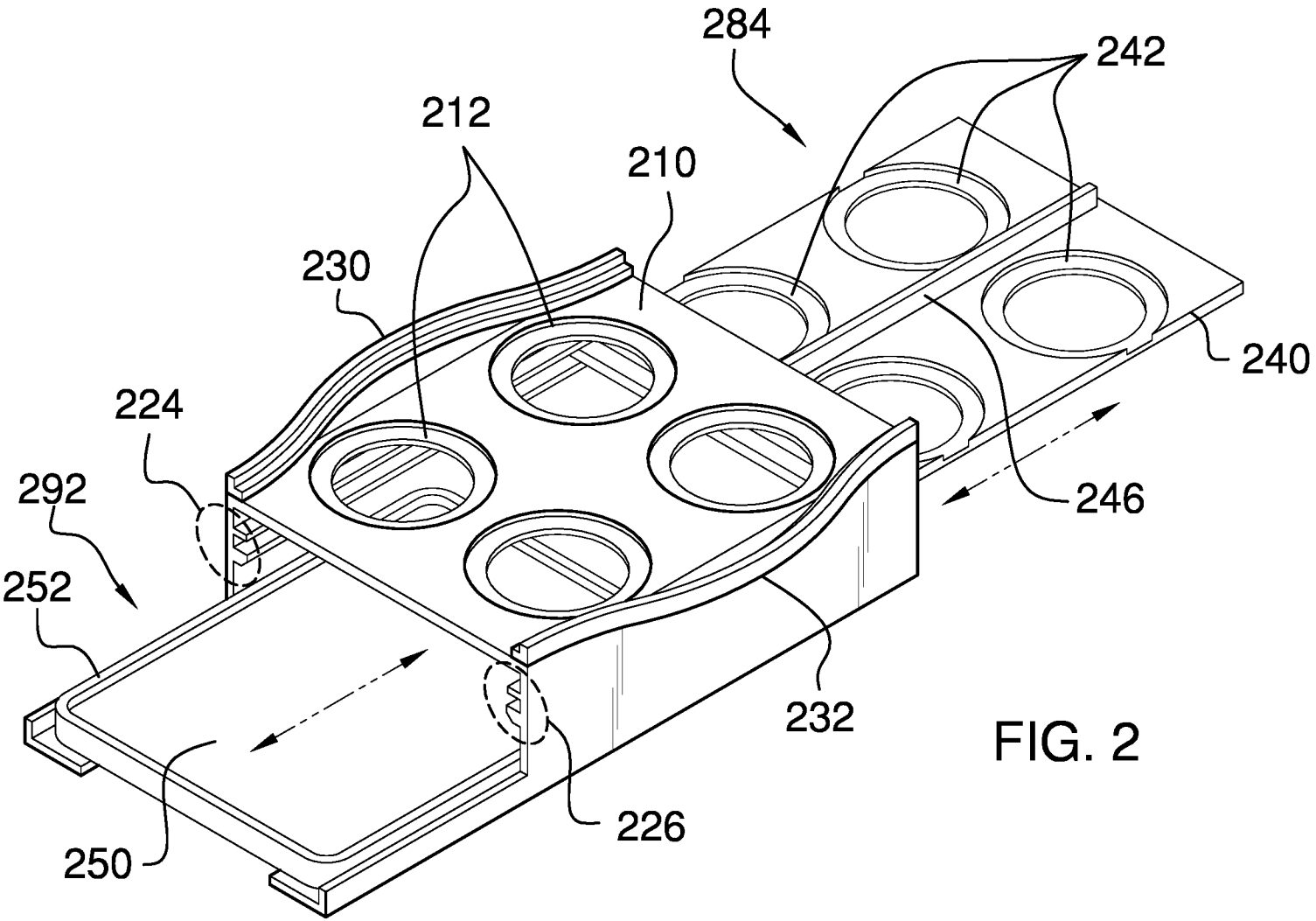
FIG. 2 is an exploded view of an embodiment of the disclosure illustrating the intermediate tray and the bottom tray both deployed for use.
Figure 3:
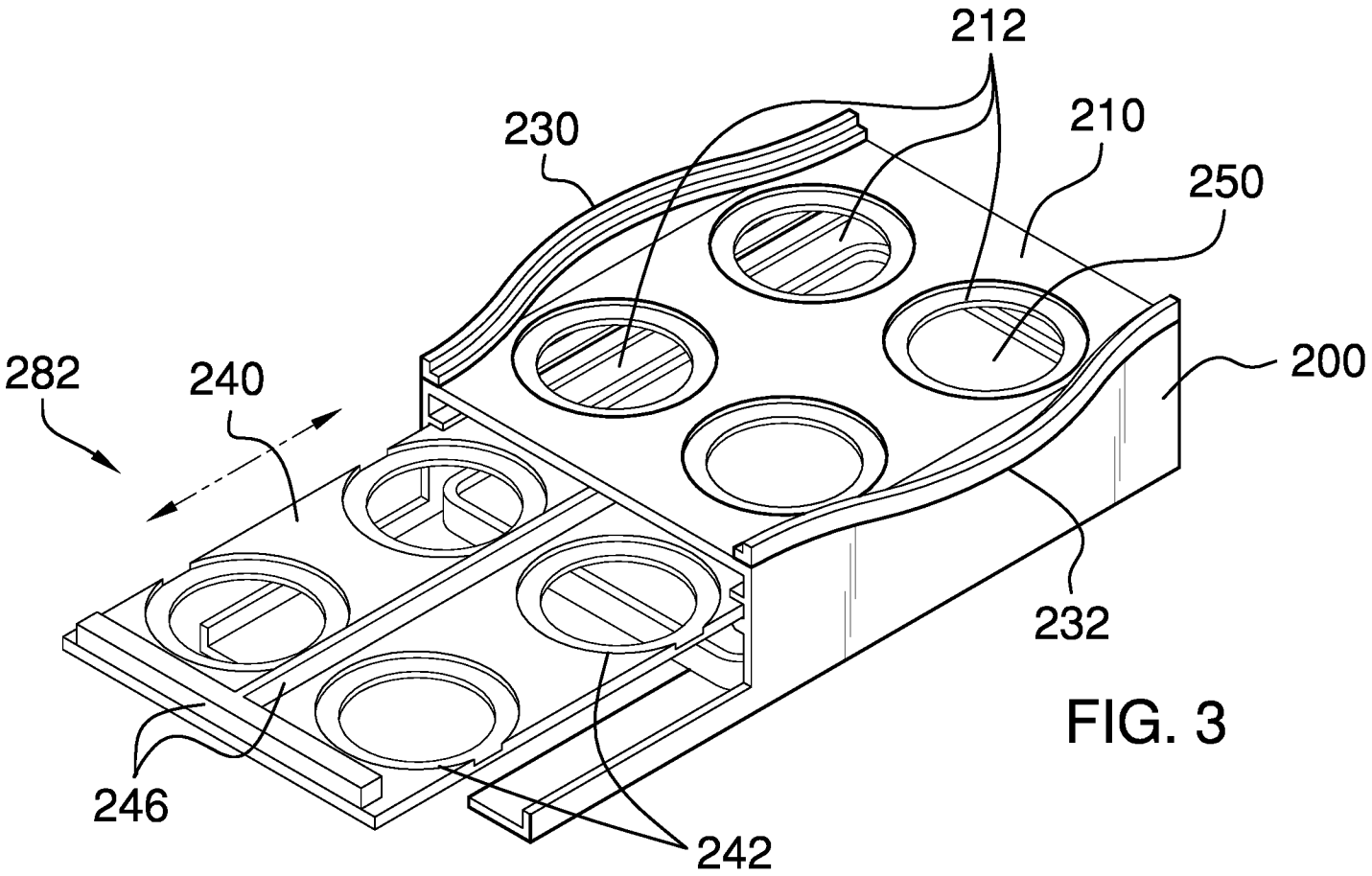
FIG. 3 is an exploded view of an embodiment of the disclosure illustrating the intermediate try only deployed for use.
Figure 4:
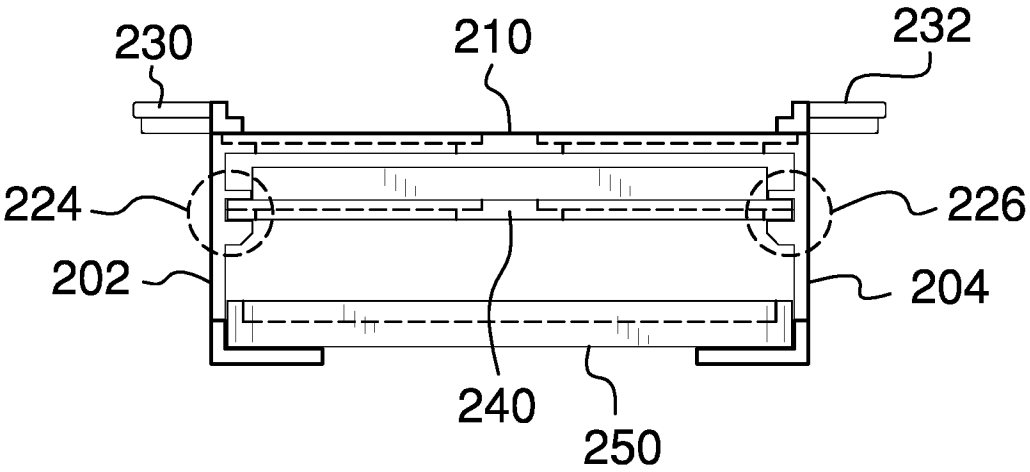
FIG. 4 is a front view of an embodiment of the disclosure.
Figure 5:
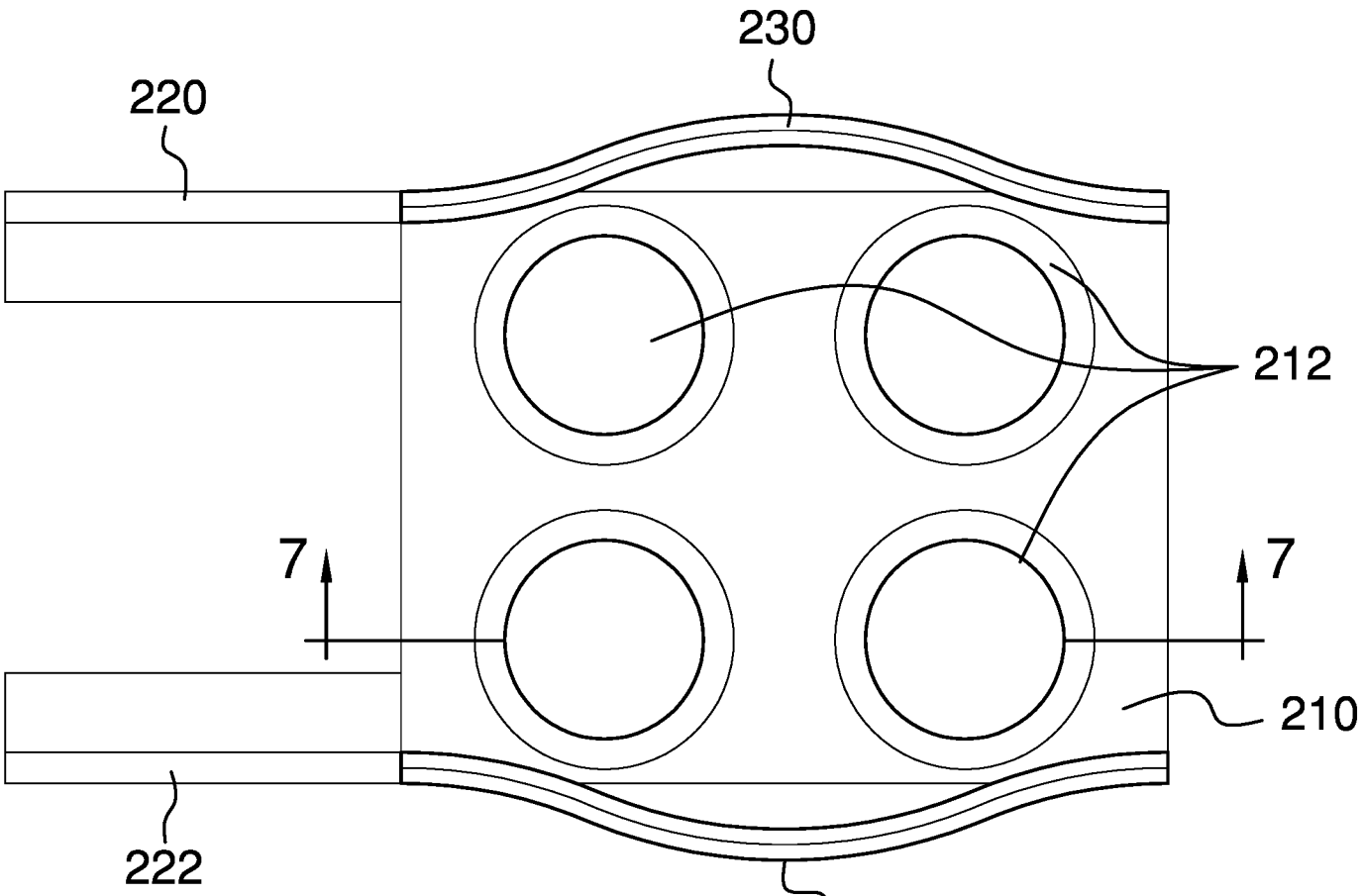
FIG. 5 is a top view of an embodiment of the disclosure.
Figure 6:
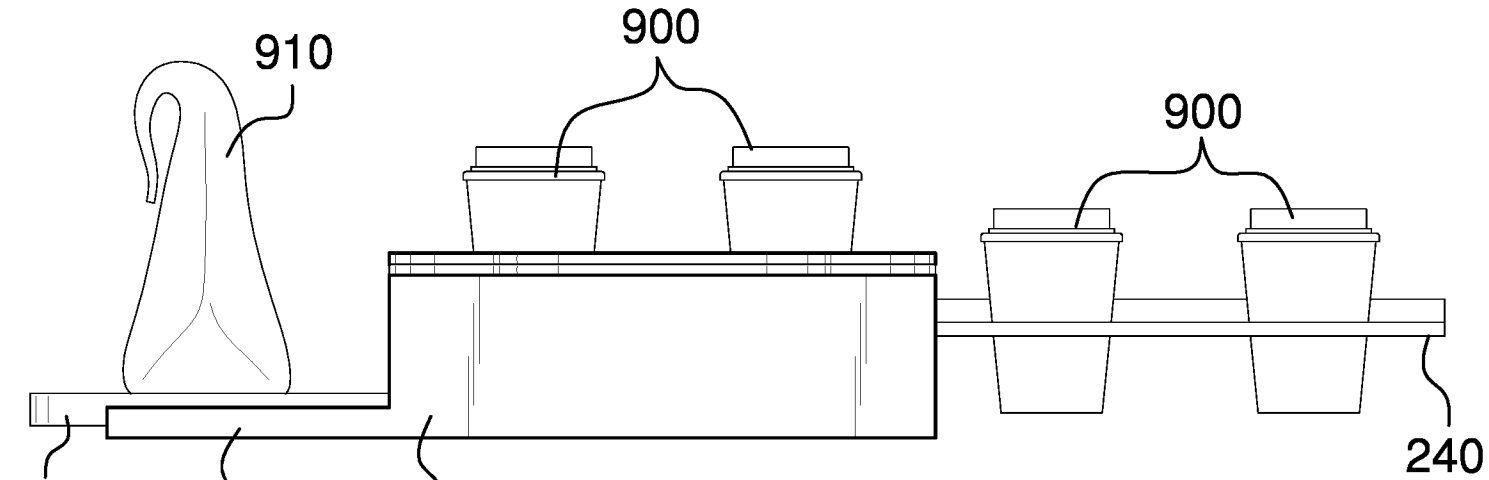
FIG. 6 is a side in-use view of an embodiment of the disclosure illustrating food and beverages being carried by the top surface, the intermediate tray, and the bottom tray.
Figure 7:
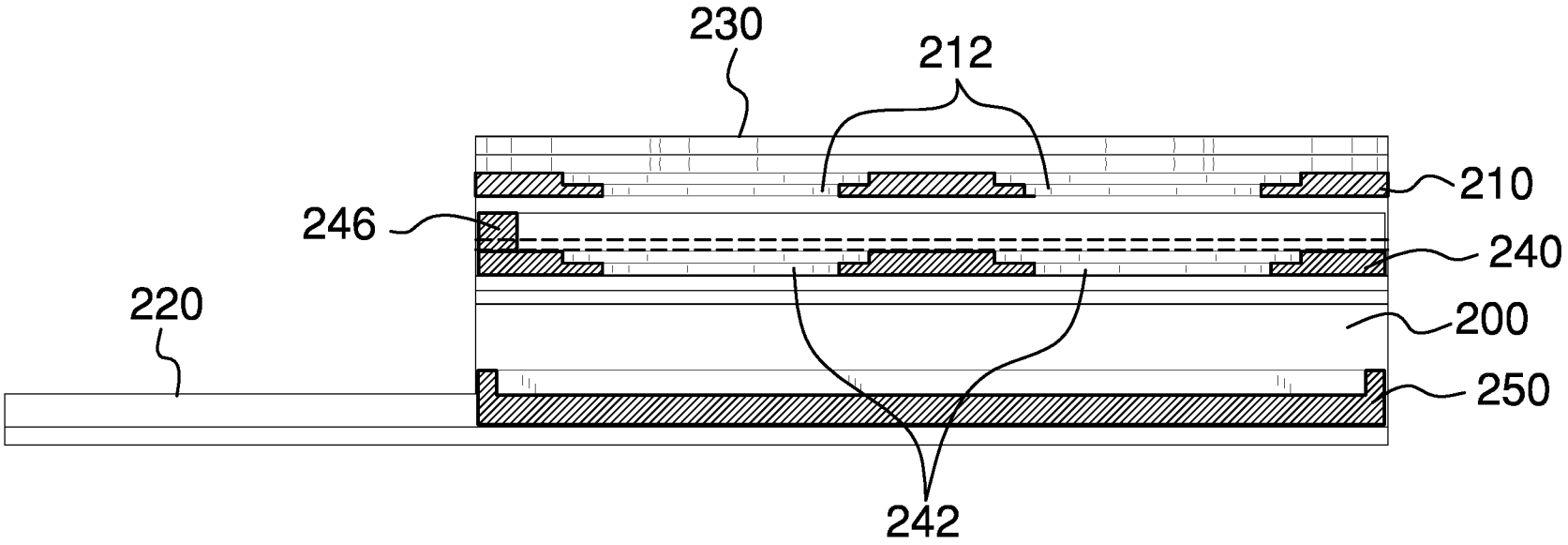
FIG. 7 is a cross-sectional view of an embodiment of the disclosure across 7-7 as shown in FIG. 5.

Detailed reference will now be made to a first potential embodiment of the disclosure, which is illustrated in FIGS. 1 through 7.

The expandable beverage tray 100 (hereinafter invention) comprises a carrier body 200, an intermediate tray 240, and a bottom tray 250. The invention 100 may be adapted to hold beverages and food being delivered by a delivery person. A top surface 210 of the carrier body 200 may be adapted to hold a plurality of beverage cups 900 in a first plurality of cup apertures 212. The intermediate tray 240 and the bottom tray 250 may reside within the carrier body 200 aligned with the top surface 210 such that the intermediate tray 240 and the bottom tray 250 do not interfere with the operation of the first plurality of cup apertures 212 in the top surface 210 and do not increase the footprint of the carrier body 200. The intermediate tray 240 may be adapted to slide out of the carrier body 200 towards the front or towards the rear and hold more of the plurality of beverage cups 900 in a second plurality of cup apertures 242. The bottom tray 250 may be adapted to slide out of the carrier body 200 towards the front and hold one or more food containers 910. The intermediate tray 240 and the bottom tray 250 may slide independently of each other.

The carrier body 200 may comprise a left side wall 202, a right side wall 204, the top surface 210, a left support rail 220, a right support rail 222, a left internal track 224, and a right internal track 226. The left side wall 202 and the right side wall 204 may be vertically oriented side walls of the carrier body 200. The left side wall 202 may be oriented to be parallel to the right side wall 204. The top surface 210 may be located at the top of the carrier body 200 and may be horizontally oriented. The left edge of the top surface 210 may couple to the top of the left side wall 202 and the right edge of the top surface 210 may couple to the top of the right side wall 204. The top surface 210 may comprise the first plurality of cup apertures 212. Each of the first plurality of cup apertures 212 may be a circular aperture for holding an individual beverage cup. The diameter of an individual cup aperture may be adapted to be at least as large as the diameter of the bottom of the individual beverage cup. The diameter of the individual cup aperture may be adapted to be smaller than the diameter of the top of the individual beverage cup. The individual beverage cup may be placed into the individual cup aperture and may drop until either the sides of the individual beverage cup press against the individual cup aperture or the bottom of the individual beverage cup comes to rest on another object. As non-limiting examples, the other object may be the bottom tray 250 of the invention 100 or a seat of a vehicle. The individual cup aperture may prevent the individual beverage cup from tipping during transit.

The left support rail 220 and the right support rail 222 may be horizontally oriented guide rails for supporting the bottom tray 250 and may be located at the bottom of the carrier body 200. The left support rail 220 and the right support rail 222 may extend in front of the carrier body 200. The left support rail 220 and the right support rail 222 may have an L-shaped vertical cross-section. The vertical portion of the left support rail 220 may be the left side wall 202 or a forward extension of the left side wall 202. The horizontal portion of the left support rail 220 may project perpendicularly from the bottom of the left support rail 220 towards the right side wall 204. The vertical portion of the right support rail 222 may be the right side wall 204 or a forward extension of the right side wall 204. The horizontal portion of the right support rail 222 may project perpendicularly from the bottom of the right support rail 222 towards the left side wall 202.

The left internal track 224 and the right internal track 226 may support and guide the intermediate tray 240 as the intermediate tray 240 slides into and out of the carrier body 200. The left internal track 224 and the right internal track 226 may be horizontally-oriented U-channels on the inside surface of the left side wall 202 and the right side wall 204, respectively. The left internal track 224 and the right internal track 226 may be oriented to run in a front-to-rear direction. The left internal track 224 and the right internal track 226 may be located below the top surface 210 and above the bottom tray 250.

In some embodiments, the carrier body 200 may further comprise a left handle 230 and a right handle 232. The left handle 230 and the right handle 232 may be handgrips that are accessible on the left and right sides of the carrier body 200, respectively. The left handle 230 and the right handle 232 may be adapted for the delivery person to carry the invention 100.

The intermediate tray 240 may be a sliding surface located within the carrier body 200 below the top surface 210. The intermediate tray 240 may comprise the second plurality of cup apertures 242. The second plurality of cup apertures 242 may be vertically aligned with the first plurality of cup apertures 212 such that the intermediate tray 240 does not interfere with the operation of the first plurality of cup apertures 212 when the intermediate tray 240 is in an intermediate tray default position 280 within the carrier body 200 and is not being used. The left and right edges of the intermediate tray 240 may be sized to fit within the left internal track 224 and the right internal track 226 such that the intermediate tray 240 may slide within the left internal track 224 and the right internal track 226. The intermediate tray 240 may slide forward to an intermediate tray forward position 282 or rearward to an intermediate tray rearward position 284 by a distance that permits the second plurality of cup apertures 242 to be exposed outside of the carrier body 200. The second plurality of cup apertures 242 may hold more of the individual beverage cups when the intermediate tray 240 is in the intermediate tray forward position 282 or the intermediate tray rearward position 284. In some embodiments, the intermediate tray 240 may be completely removed from the carrier body 200 by sliding it forward and/or rearward by at least the front to rear length of the intermediate tray 240. The intermediate tray 240 may further comprise one or more stiffeners 246. The one or more stiffeners 246 may be one or more thickenings of the intermediate tray 240 to reduce flexing of the intermediate tray 240 under the weight of the individual beverage cups. The one or more stiffeners 246 may be oriented front-to-rear, side-to-side, diagonally, or combinations thereof.

The bottom tray 250 may be a sliding surface located within the carrier body 200 below the intermediate tray 240. The bottom tray 250 may comprise a rigid horizontal surface that may be surrounded by a rim 252. The left and right sides of the bottom tray 250 may be supported by the left support rail 220 and the right support rail 222, respectively. The bottom tray 250 may be positioned in a bottom tray default position 290 within the carrier body 200 when not in use. The bottom tray 250 may slide forward to a bottom tray forward position 292 to be exposed outside of the carrier body 200. The one or more food containers 910 may be carried on the bottom tray 250 while the bottom tray 250 is in the bottom tray forward position 292. In some embodiments, the bottom tray 250 may be completely removed from the carrier body 200 by sliding it forward and/or rearward by at least the front to rear length of the bottom tray 250. The rim 252 may be vertically oriented. The rim 252 may stiffen the bottom tray 250 and may prevent the one or more food containers 910 from sliding off of the bottom tray 250.

In a preferred embodiments, the top surface 210 may carry four of the individual beverage cups and the intermediate tray 240 may carry an additional four of the individual beverage cups.

In use, the invention 100 may be configured to carry the beverages and food. Specifically, the intermediate tray 240 may be pulled out of the carrier body 200 if the count of the individual beverage cups exceeds the capacity of the top surface 210 and the bottom tray 250 may be pulled out of the carrier body 200 if the one or more food containers 910 are to be carried. If both the intermediate tray 240 and the bottom tray 250 are to be used, then the intermediate tray 240 may be moved to the intermediate tray rearward position 284 and the bottom tray 250 may be moved to the bottom tray forward position 292. If only the intermediate tray 240 is needed, the intermediate tray 240 may be moved to the intermediate tray forward position 282 and the bottom tray 250 may be left in the bottom tray default position 290. If only the bottom tray 250 is needed, the intermediate tray 240 may be left in the intermediate tray default position 280 and the bottom tray 250 may be moved to the bottom tray forward position 292. The plurality of beverage cups 900 may be placed into the first plurality of cup apertures 212 and/or the second plurality of cup apertures 242. The one or more food containers 910 may be placed upon the bottom tray 250. The invention 100 may be carried to a customer directly or to a vehicle where it may be placed upon a seat or other support surface for transmit to the customer.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, a "cross-section" may be a surface or shape that would be exposed by making a straight cut through an object.

As used in this disclosure, a "diameter" of an object is a straight line segment that passes through the center (or center axis) of an object. The line segment of the diameter is terminated at the perimeter or boundary of the object through which the line segment of the diameter runs.

As used here, "footprint" may refer to a vertical, downward projection of an object onto the surface that supports the object. The portion of the supporting surface that is within the footprint is, by definition, underneath the object.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, the term "intermediate" may refer to a location that lies between a first object and a second object As used herein, "rigid" may refer to an object or material which is inflexible. A rigid object may break if force is applied to the object.

As used in this disclosure, a "rim" may be an outer edge or border that follows along the perimeter of an object.

As used herein, "stiffen" may refer to an increase in the rigidity of an object. Specifically, if it now takes more force to achieve the same amount of deformation of an object that previously required a lesser amount of force to achieve, then the object is said to have stiffened.

As used in this disclosure, a "track" may be a device that is used to control the path of motion of an object in at least one dimension.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An expandable beverage tray comprising:

a carrier body, an intermediate tray, and a bottom tray;

wherein the expandable beverage tray is adapted to hold beverages and food being delivered by a delivery person;

wherein a top surface of the carrier body is adapted to hold a plurality of beverage cups in a first plurality of cup apertures;

wherein the intermediate tray and the bottom tray reside within the carrier body aligned with the top surface such that the intermediate tray and the bottom tray do not interfere with an operation of the first plurality of cup apertures in the top surface and do not increase a footprint of the carrier body;

wherein the intermediate tray is adapted to slide out of the carrier body towards a front or towards a rear and hold more of the plurality of beverage cups in a second plurality of cup apertures;

wherein the bottom tray is adapted to slide out of the carrier body towards the front and hold one or more food containers;

wherein the carrier body comprises a left side wall, a right side wall, the top surface, a left support rail, a right support rail, a left internal track, and a right internal track;

wherein the left side wall and the right side wall are vertically oriented side walls of the carrier body;

wherein the left side wall is oriented to be parallel to the right side wall;

wherein the left support rail and the right support rail are horizontally oriented guide rails for supporting the bottom tray and are located at the bottom of the carrier body;

wherein the left support rail and the right support rail extend in front of the carrier body.

2. The expandable beverage tray according to claim 1 wherein the intermediate tray and the bottom tray slide independently of each other.

3. The expandable beverage tray according to claim 2 wherein the top surface is located at the top of the carrier body and is horizontally oriented;

wherein the left edge of the top surface is coupled to the top of the left side wall and the right edge of the top surface is coupled to the top of the right side wall;

wherein the top surface comprises the first plurality of cup apertures.

4. The expandable beverage tray according to claim 3 wherein each of the first plurality of cup apertures is a circular aperture for holding an individual beverage cup.

5. The expandable beverage tray according to claim 4 wherein the diameter of an individual cup aperture is adapted to be at least as large as the diameter of the bottom of the individual beverage cup;

wherein the diameter of the individual cup aperture is adapted to be smaller than the diameter of the top of the individual beverage cup;

wherein the individual beverage cup is placed into the individual cup aperture and drops until either the sides of the individual beverage cup press against the individual cup aperture or the bottom of the individual beverage cup comes to rest on another object;

wherein the individual cup aperture prevents the individual beverage cup from tipping during transit.

6. The expandable beverage tray according to claim 5 wherein the left support rail and the right support rail have an L-shaped vertical cross-section;

wherein the vertical portion of the left support rail is the left side wall or a forward extension of the left side wall;

wherein the horizontal portion of the left support rail projects perpendicularly from the bottom of the left support rail towards the right side wall;

wherein the vertical portion of the right support rail is the right side wall or a forward extension of the right side wall;

wherein the horizontal portion of the right support rail projects perpendicularly from the bottom of the right support rail towards the left side wall.

7. The expandable beverage tray according to claim 6 wherein the left internal track and the right internal track support and guide the intermediate tray as the intermediate tray slides into and out of the carrier body;

wherein the left internal track and the right internal track are horizontally-oriented U-channels on the inside surface of the left side wall and the right side wall, respectively;

wherein the left internal track and the right internal track are oriented to run in a front-to-rear direction.

8. The expandable beverage tray according to claim 7 wherein the left internal track and the right internal track are located below the top surface and above the bottom tray.

9. The expandable beverage tray according to claim 8 wherein the carrier body further comprises a left handle and a right handle;

wherein the left handle and the right handle are handgrips that are accessible on the left and right sides of the carrier body, respectively;

wherein the left handle and the right handle are adapted for the delivery person to carry the expandable beverage tray.

10. The expandable beverage tray according to claim 8 wherein the intermediate tray is a sliding surface located within the carrier body below the top surface;

wherein the intermediate tray comprises the second plurality of cup apertures;

wherein the second plurality of cup apertures are vertically aligned with the first plurality of cup apertures such that the intermediate tray does not interfere with the operation of the first plurality of cup apertures when the intermediate tray is in an intermediate tray default position within the carrier body and is not being used.

11. The expandable beverage tray according to claim 10 wherein the left and right edges of the intermediate tray are sized to fit within the left internal track and the right internal track such that the intermediate tray slides within the left internal track and the right internal track;

wherein the intermediate tray slides forward to an intermediate tray forward position or rearward to an intermediate tray rearward position by a distance that permits the second plurality of cup apertures to be exposed outside of the carrier body;

wherein the second plurality of cup apertures holds more of the individual beverage cups when the intermediate tray is in the intermediate tray forward position or the intermediate tray rearward position.

12. The expandable beverage tray according to claim 11 wherein the intermediate tray is completely removed from the carrier body by sliding it forward and/or rearward by at least the front to rear length of the intermediate tray.

13. The expandable beverage tray according to claim 11 wherein the intermediate tray further comprises one or more stiffeners;

wherein the one or more stiffeners are one or more thickenings of the intermediate tray to reduce flexing of the intermediate tray under the weight of the individual beverage cups;

wherein the one or more stiffeners are oriented front-to-rear, side-to-side, diagonally, or combinations thereof.

14. The expandable beverage tray according to claim 13 wherein the bottom tray is a sliding surface located within the carrier body below the intermediate tray;

wherein the bottom tray comprises a rigid horizontal surface that is surrounded by a rim.

15. The expandable beverage tray according to claim 14 wherein the left and right sides of the bottom tray are supported by the left support rail and the right support rail, respectively;

wherein the bottom tray is positioned in a bottom tray default position within the carrier body when not in use;

wherein the bottom tray slides forward to a bottom tray forward position to be exposed outside of the carrier body;

wherein the one or more food containers are carried on the bottom tray while the bottom tray is in the bottom tray forward position.

16. The expandable beverage tray according to claim 15 wherein the bottom tray is completely removed from the carrier body by sliding it forward and/or rearward by at least the front to rear length of the bottom tray.

17. The expandable beverage tray according to claim 15 wherein the rim is vertically oriented;

wherein the rim stiffens the bottom tray and prevents the one or more food containers from sliding off of the bottom tray.

* * * * *